US010132205B2

(12) United States Patent
Lahr

(10) Patent No.: US 10,132,205 B2
(45) Date of Patent: Nov. 20, 2018

(54) ADJUSTING DEVICE FOR A VALVE CLEARANCE OF A CHARGE-CYCLE VALVE AND METHODS FOR ADJUSTING A VALVE CLEARANCE OF A CHARGE-CYCLE VALVE

(71) Applicant: Daimler AG, Stuttgart (DE)

(72) Inventor: Matthias Lahr, Schwaebisch Gmuend (DE)

(73) Assignee: Daimler AG, Stuttgart (DE)

( * ) Notice: Subject to any disclaimer, the term of this patent is extended or adjusted under 35 U.S.C. 154(b) by 207 days.

(21) Appl. No.: 15/106,118

(22) PCT Filed: Dec. 6, 2014

(86) PCT No.: PCT/EP2014/003277
§ 371 (c)(1),
(2) Date: Sep. 22, 2016

(87) PCT Pub. No.: WO2015/090530
PCT Pub. Date: Jun. 25, 2015

(65) Prior Publication Data

US 2017/0009608 A1 Jan. 12, 2017

(30) Foreign Application Priority Data

Dec. 19, 2013 (DE) ..... 10 2013 021 566

(51) Int. Cl.
*F01L 1/14* (2006.01)
*F01L 1/22* (2006.01)
(Continued)

(52) U.S. Cl.
CPC ..... *F01L 1/22* (2013.01); *F01L 1/047* (2013.01); *F01L 1/053* (2013.01); *F01L 1/181* (2013.01); *F01L 2003/11* (2013.01)

(58) Field of Classification Search
CPC ... F01L 1/181; F01L 1/22; F01L 1/053; F01L 2003/11
(Continued)

(56) References Cited

U.S. PATENT DOCUMENTS 2,720,874 A 10/1955 Brooks
2,752,904 A 7/1956 Russell
(Continued)

FOREIGN PATENT DOCUMENTS

DE 38 13 703 A1 11/1988
DE 10 2009 018 963 A 10/2010
(Continued)

OTHER PUBLICATIONS

PCT/EP2014/003277, International Search Report dated Oct. 12, 2015 (Three (3) pages).
(Continued)

*Primary Examiner* — Ching Chang
(74) *Attorney, Agent, or Firm* — Crowell & Moring LLP

(57) ABSTRACT

An adjusting device for adjusting valve clearance of a charge-cycle valve of an internal combustion machine is provided. The adjusting device includes a pivoted rocker lever, at one end of which an actuation element is positioned configured to transfer a force to the charge-cycle valve. A transmission element is attached to the actuation element at an opposite end to the charge-cycle valve of which a sleeve area is positioned, which is used to support the transmission element regarding the actuation element. A method for adjusting valve clearance of a charge-cycle valve of an internal combustion machine using an adjusting device is also provided.

3 Claims, 2 Drawing Sheets

(51) Int. Cl.

| | |
|---|---|
| ***F01L 1/053*** | (2006.01) |
| ***F01L 1/18*** | (2006.01) |
| ***F01L 1/047*** | (2006.01) |
| *F01L 3/00* | (2006.01) |

(58) Field of Classification Search
USPC ..... 123/90.39, 90.44, 90.48, 90.54
See application file for complete search history.

(56) References Cited

U.S. PATENT DOCUMENTS

| | | | |
|---|---|---|---|
| 3,024,775 | A | 3/1962 | Wuest |
| 4,182,289 | A | 1/1980 | Nakajima et al. |
| 2011/0005484 | A1 | 1/2011 | Yasui et al. |
| 2012/0227695 | A1 | 9/2012 | Bokura et al. |

FOREIGN PATENT DOCUMENTS

| | | | |
|---|---|---|---|
| GB | 173362 | A | 1/1922 |
| GB | 2 203 811 | A | 10/1988 |

OTHER PUBLICATIONS

German Search Report issued in German counterpart application No. 10 2013 021 566.8 dated Mar. 11, 2014, with Statement of Relevancy (Six (6) pages).

ADJUSTING DEVICE FOR A VALVE CLEARANCE OF A CHARGE-CYCLE VALVE AND METHODS FOR ADJUSTING A VALVE CLEARANCE OF A CHARGE-CYCLE VALVE

BACKGROUND AND SUMMARY OF THE INVENTION

The invention relates to an adjusting device for adjusting valve clearance for a charge-cycle valve of an internal combustion machine with a pivoted rocker lever, at the one end of which an actuation element is positioned that can be used to transfer a force to the charge-cycle valve. Furthermore, the invention relates to a method for adjusting valve clearance of a charge-cycle valve of an internal combustion machine using an adjusting device including a pivoted rocker lever, to the one end of which an actuation element is attached that can be used to transfer an actuation force to the charge-cycle valve.

For example, such an adjusting device for a charge-cycle valve is already described in DE 10 2009 018 963 A1 and thus is already known. The adjusting device described therein is designed as a valve clearance adjusting element and is positioned at a valve drive device for actuating at least one axially movable charge-cycle valve with an actuation unit that can be tilted by an actuation axis. The actuation unit includes a valve actuation element for coupling with the charge-cycle valve, as well as the valve clearance adjusting element for axial adjustment of the valve actuation element, and a ball joint positioned between the valve actuation element and the valve clearance adjusting element. The ball joint positioned there is oriented in a defined manner using a reset device once the ball joint has adopted a non-actuated operating condition. The reset element positioned there includes a spring element at least partially positioned within the ball joint. The spring element positioned there is designed as a so-called bending pin and is subject to particularly frequent alternating loads during motor operation, i.e., when actuating the valve for charge changing of a combustion chamber of the internal combustion machine. Therefore, there is the risk of a fatigue fracture or a misalignment of the valve clearance due to the frequently alternating loads of the reset device.

In order to adjust the valve clearance regarding rocker lever valve drives (without hydraulic clearance balancing elements such as hydraulic plungers), an adjusting screw or adjusting nut is used in most cases, with this screw or nut being equipped with a locking element in order to hold its position (for instance, nut or setscrew). These adjusting screws and nuts, respectively, of the locking element are usually tightened applying a high torque upon successful adjustment and fine adjustment, respectively, with this tightening occasionally mostly resulting in the previously set clearance value being misaligned. Furthermore, at least two tools are necessary requiring a corresponding clearance at the valve drive and simultaneous meshing. The locking torque introduced with the help of the tools is absorbed via the respective component bearing points and must be taken into account when designing the clearance value, i.e., the bearing clearance, due to possible component deformations caused by introducing the torque.

The purpose of the present invention is to create an adjusting device as well as a method for adjusting a valve clearance of a charge-cycle valve of an internal combustion machine using an adjusting device of the above-mentioned type that can be used to particularly accurately adjust a valve clearance with little effort and to simultaneously permanently eliminate deviations from the preset valve clearance during motor operation.

In order to create an adjusting device of the above-mentioned type, which can be used to permanently and accurately adjust a valve clearance using simple means, it is provided according to the invention that a transmission element is attached to the actuation element, at the end opposite of the charge-cycle valve of which a sleeve area is positioned supporting the transmission element regarding the actuation element. Due to the transmission element being supported regarding the actuation element by means of its sleeve area, it is possible to efficiently prevent any tilting of the transmission element in relation to the actuation element and to thus comply with more accurate position tolerances the longer the sleeve area. In this, the transmission element serves as a clearance balancing element and automatically maintains a preset position, with the transmission element not requiring any additional attachment and locking, respectively, within the framework of an additional installation step. As a consequence, the valve clearance adjustment of the charge-cycle valve can be performed particularly easily and quickly by the technician. In so doing, particularly misalignments and damages to the individual components of the adjusting device are avoided and possible maintenance times are shortened. Furthermore, the installation space and free tool access, respectively, required for installation is reduced.

In an advantageous embodiment of the invention, the transmission element has an internal area and an external area. For example, the internal area and the external area may have a cylindrical contour each and be thus positioned concentrically to one another. By positioning the internal area, in relation to the external area, in a concentric manner, it is, for instance, possible to initially create the internal area, for example in the form of a drilled hole, with this drilled hole then serving as the bearing point when creating and processing, respectively, the external area. As a consequence, the internal area and the external area can be aligned in relation to one another with a particular level of accuracy and using particularly simple means and thus the transmission element can be designed particularly accurately with particularly low manufacturing effort.

It has further been shown to be advantageous if the internal area has a female thread and the external area has a male thread for supporting the transmission element regarding the actuation element. The female thread and the male thread can be aligned particularly accurately to one another in the case of a respective concentric position to one another. Furthermore, the two threads can each be characterized by a particularly low pitch, inhibiting any misalignment of the valve clearance during the alternating load caused by operating the charge-cycle valve (self-inhibition), since it is possible to particularly efficiently prevent a relative rotation between the transmission element and the actuation element in the event of a low pitch of the respective threads.

Furthermore, it is particularly advantageous if the transmission element is supported at the actuation element via its female thread using a pre-stressed bolt. In so doing, the pre-stressed bolt is screwed into the transmission element and is supported using a contact face of the pre-stressed bolt's head at the actuation element. As a consequence, an internal force fit between the pre-stressed bolt, the transmission element and the actuation element is provided for, locally limiting possible component warpage due to the mutual bracing to a special degree, which is accordingly low.

In a preferred embodiment, the transmission element is supported at a thread of the actuation element using its external thread. As a matter of principle, threads are characterized by a certain clearance, which, as a consequence of the mutual bracing, is minimized particularly by the fact that both the internal thread and the external thread are loaded. Hence, the transmission element is not only screwed to the actuation element via its external thread, but is also screwed to the pre-stressed bolt via its internal thread, and accordingly both threads, i.e., both the internal and the external thread of the transmission element, are meshed with a load and braced in relation to one another under opposite-directional force effect. As a consequence, the transmission element is fixed in a particularly stationary manner, it being understood that a torque required for rotating the transmission element, with the torque being applied by using a tool, for example, is higher the higher the clamping force between the internal thread and the external thread, since an increased clamping force also entails an increased friction torque between the respective turns to be applied during rotation.

Ultimately, it has proved advantageous when the internal thread and the external thread of the transmission element are characterized by the same pitch. If the pitches of the internal thread and the external thread are identical, each of the load-bearing thread flanks is loaded particularly uniformly, allowing for the implementation of all the more high tightening torques. The application of high tightening torques guarantees a particularly high level of safety regarding any misalignment of the transmission element during alternating loads due to valve actuation during motor operation.

Within the framework of the method for adjusting a valve clearance of a charge-cycle valve of an internal combustion machine according to the invention, a transmission element is attached to the actuation element by compensating an external area of the transmission element, a clamping element is attached to an internal area of the transmission element, the transmission element is braced with the actuation element by applying a torque to the clamping element, as well as the clamping element is connected to the actuation element by means of a firm bond.

If, advantageously, a so-called pre-stressed bolt is used as the clamping element, the valve clearance can be secured against misalignment particularly permanently. By firmly bonding, i.e., through gluing, soldering, or welding, for example, the clamping element to the actuation element, the safety regarding a misalignment of the valve clearance is further increased.

The advantages and embodiments described for the adjusting device according to the invention are also applicable to the method according to the invention and vice versa.

The features and combinations of features mentioned within the framework of the above description, as well as the features and combinations of features mentioned in the below description of the figures and/or illustrated alone in the figures may not only be used within the framework of the combination specified in each case, but also within the framework of other combinations or alone, without exceeding the scope of the invention in so doing.

Further advantages, features, and details of the invention can be derived from the following description of preferred embodiments, as well as based on the drawings.

DETAILED DESCRIPTION OF THE DRAWINGS

Figure 1:
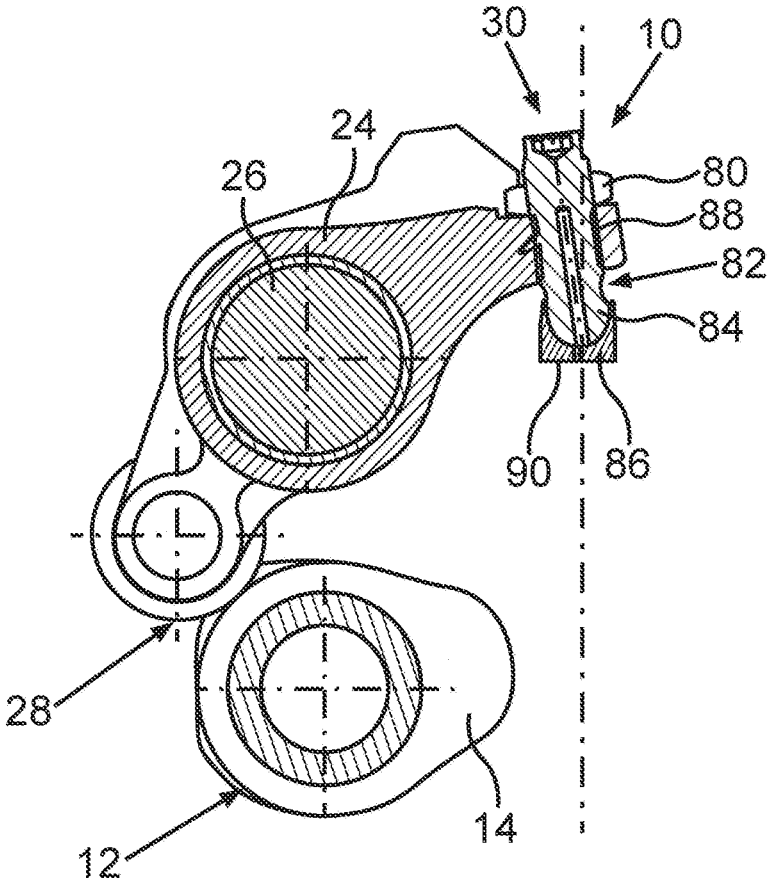
Fig.1 (Prior art)
FIG. 1 is a sectional view of an adjusting device known from the state of the art with a locking nut, an adjusting screw, as well as a ball cup, supported in a ball head of the adjusting screw.

FIG. 1 illustrates an adjusting device 10 known from the state of the art for adjusting a valve clearance of a valve of an internal combustion machine not illustrated herein. In this, a rocker lever 24 is actuated using respective cams 14 of a camshaft 12, connected to a crankshaft of the internal combustion machine not illustrated herein. The rocker lever 24 is pivoted at a pivot bearing 26, with its end 28 being moved depending on the speed of the camshaft 12 and the cam contour of the cam 14. Moving the end 28 of rocker lever 24 lifts and lowers, respectively, an end 30 of the rocker lever 24 opposite to the end 28. At the end 30, the adjusting device 10 is positioned, including a locking nut 80, an adjusting screw 82, and a ball cup 86, with the ball cup 86 being pivoted at a ball head 84 of the adjusting screw 82. At the end opposite to the end 30 of rocker lever 24, the ball cup 86 has a level contact face 90, contacted with the valve not illustrated herein for valve actuation during motor operation and exerting an actuation force on the valve by swiveling rocker lever 24 as a consequence of its deflection through the rotation of the camshaft 12, with it being possible to open this valve against a spring force of a valve spring not illustrated in FIG. 1 and hence, depending on whether the valve is an inlet or an outlet valve, fresh air and exhaust gas, respectively, can flow into a combustion chamber of the internal combustion machine not illustrated herein and escape from a combustion chamber of the internal combustion machine not illustrated herein, respectively. Now, the valve clearance is adjusted using this adjusting device 10 known from the state of the art by initially screwing the adjusting screw 82 in an internal thread 88 positioned at the end 30 of rocker lever 24 and fixing the adjusting screw 82 using the locking nut 80 positioned at an end of the adjusting screw 82 opposite of the ball head 84. In order to adjust the valve clearance, the adjusting screw 82 is screwed in the internal thread 88 until the valve clearance has been set accurately, with the adjusting screw 82 being fixed using the locking nut 80 afterwards. In order to prevent the valve clearance from being changed, the adjusting screw is fixed by tightening the locking nut 80 applying a high torque. This torque for tightening the locking nut 80 and therefore for fixing the adjusting screw 82 may result in an accidental misalignment of the clearance value previously set for the valve clearance, since settlement phenomena may occur in the internal thread 88 and in the thread of the adjusting screw 82 meshed with the internal thread 88, respectively. Furthermore, at least two tools are necessary requiring the corresponding free access to the valve drive and to be meshed simultaneously at the adjusting device 10 in order to lock the adjusting screw 82 using the locking nut 80. Due to the need for at least two simultaneously meshing tools, it is necessary to design a corresponding free access at the valve drive to be adjusted.

Figure 2A:
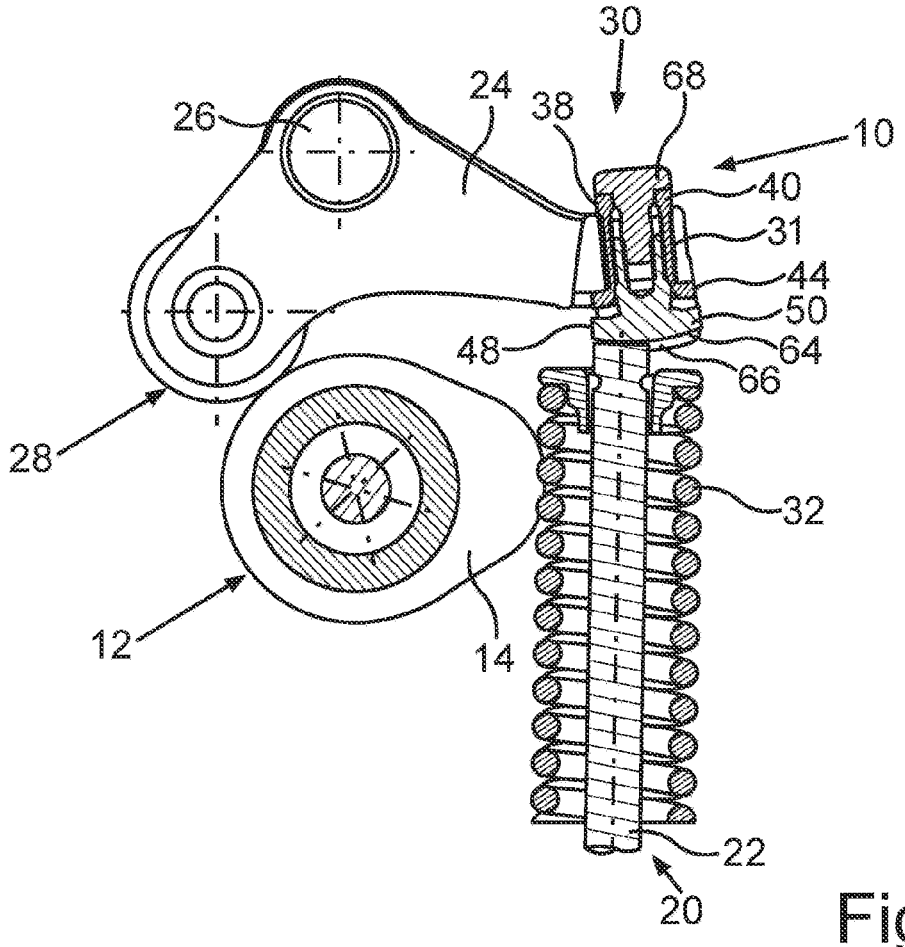
FIG. 2*a* is a sectional view of an adjusting device according to an embodiment of the invention.
Figure 2B:
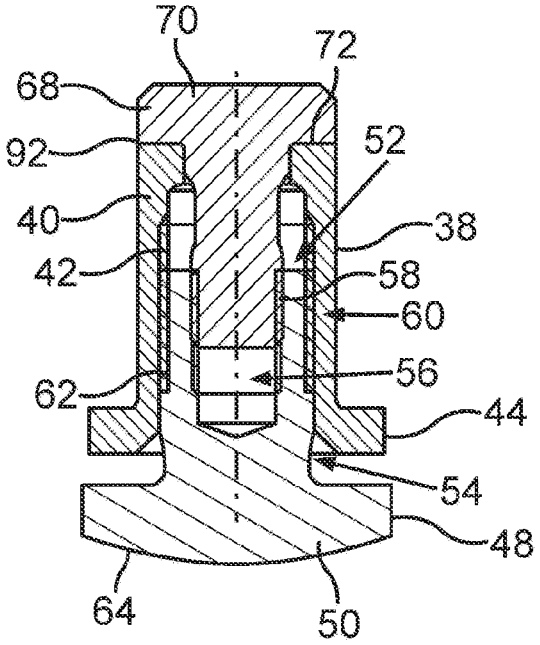
FIG. 2*b* is an enlarged sectional view of the adjusting device according to the embodiment illustrated in FIG. 2*a*, including a transmission element braced with the actuation element and with a clamping element, designed as a pre-stressed bolt, using respective internal and external threads, respectively.

As opposed to FIG. 1, the sectional representations in FIG. 2*a* and FIG. 2*b* illustrate an embodiment of an adjusting device 10 exemplary for the invention for a valve clearance of a charge-cycle valve. Identical and functionally identical elements have the same reference numbers in this. The actuation of rocker lever 24 using the camshaft 12 has already been explained based on FIG. 1, which is why this will not be dealt with in further detail below.

As shown in FIG. 2*a*, the end 30 of an embodiment of the adjusting device 10 exemplary for the invention is designed to have a substantially sleeve-shaped actuation element 40. The actuation element 40 has a cylindrical outer surface 38, with the help of which the actuation element 40 is supported at the end 30 in a complementarily shaped drilled hole 31 of rocker lever 24 in a way that it can be longitudinally displaced and pivoted. The actuation element 40 contains a transmission element 50. For this, the transmission element 50 has an external area 60. In the present invention, the external area 60 has a male thread 62 that is screwed onto a female thread 42 of the actuation element 40. Put another way, the transmission element 50 uses its male thread 62 to support on the female thread 42 of the actuation element 40. In another step, a clamping element designed as a pre-stressed bolt 68 in the present invention is attached to an internal area 56 of the transmission element 50. In so doing, the pre-stressed bolt 68 is screwed in a female thread 58 of the transmission element 50 positioned at the internal area 56 until a head 70 of the pre-stressed bolt 68 contacts the actuation element 40. The head 70 (hexagonal screw head) of the pre-stressed bolt 68 has a contact face 72 then contacting the actuation element 40. Put another way, the transmission element 50 then is supported additionally at the actuation element 40 using its female thread 58 with the help of the pre-stressed bolt 68.

In summary, the transmission element 50 has a sleeve area 54 with the internal area 56 and the external area 60, with the internal area 56 having the female thread 58 and the external area 60 having the male thread 62 for supporting the transmission element 50 regarding the actuation element 40. The sleeve area 54 is positioned at an end 52 of the transmission element 50 that is opposed to a charge-cycle valve 20, with the transmission element 50 having a contact face 64 at an end of the transmission element 50 opposed to the end 52 that contacts a valve shaft 22 of the present charge-cycle valve 20 illustrated in part only herein. When operating the internal combustion machine, a corresponding force is transferred to the charge-cycle valve 20 by swiveling the rocker lever 24 compensating the contact face 64, with the valve being opened against a spring force of a spring 32, designed as a valve spring. The contact face 64 has a curved surface so that, when swiveling the rocker lever 24, the contact face 64 can slide on the valve shaft 22 of the charge-cycle valve 20 by means of a line contact.

In order to attach the transmission element 50 to the actuation element 40, the transmission element 50 has a square 48 in the area of the contact face 64, with the help of which the transmission element 50 can be screwed to the actuation element 40 by applying a torque. Due to the already mentioned attachment of the clamping element, i.e., the pre-stressed bolt 68, to the internal area 56 of the transmission element 50, the transmission element 50 may then be attached particularly torque-proof inside the actuation element 40 using the pre-stressed bolt. Put another way, by bracing the transmission element 50 with the actuation element 40 by applying a torque to the clamping element designed as the pre-stressed bolt 68 when assembling the adjusting device 10, the transmission element 50 is protected against rotation in relation to the actuation element 40. As a consequence, this also provides for anti-misalignment protection and protection against misalignment of the valve clearance, respectively. Thus, it is possible to attach the transmission element 50 through the application of opposed torques in each case to the pre-stressed bolt and the actuation element 40 in a particularly misalignment-proof manner, with this requiring the simultaneous use of two tools, however. However, it is also possible to initially screw the transmission element 50 in the actuation element 40 and to then clamp the transmission element 50 with the actuation element 40 using the pre-stressed bolt 68 in a particularly torque-proof manner.

The female thread 58 and the male thread 62 of the transmission element 50 each have an identical low pitch, creating a particularly high self-inhibition and, as a consequence thereof, a high friction torque due to the pre-stressing force exerted by the pre-stressed bolt 68, with this pre-stressing force thus preventing the transmission element 50 from automatic misalignment and, depending on the friction conditions, as well as the selected pre-stressing force, allowing for a particularly operation-proof and permanent maintenance of a preset valve clearance. In this, the friction affects both the male thread 62 and the female thread 58 and is ensured over the service life of the internal combustion machine by a corresponding design of the surfaces and coatings, respectively, of the two threads 58, 62. In order to adjust the valve clearance nevertheless, this friction torque created must be overcome, which is possible by using a tool and/or applying a torque to a hexagonal head 44 of the actuation element 40 designed as tapped bushing. For this, a flat portion 66 is designed at the end 30 of rocker lever 24, with the flat portion 66 extending at least up to the square 48 of the transmission element 50 so that the square 48 overlaps the flat portion 66. The flat portion 66 is only designed to have a low clearance regarding one side of the square 48 so that the transmission element 50 can use the flat portion 66 as a support when adjusting the valve clearance using the hexagonal head 44 of the actuation element 40, while the actuation element 40 rotates inside the drilled hole 31, which only one tool is need for. Furthermore, the flat portion 66 prevents the adjusting device 10 from rotating so that the contact face 64 of the transmission element 50 cannot rotate in relation to the valve shaft 22. For the rest, the hexagonal head 44 simultaneously serves as a stop for the actuation element 40 inside the drilled hole 31 on the rocker lever 24.

When actuating the valve, the force application is introduced into the female thread 42 of the actuation element 40 using the transmission element 50 and the male thread 52 already present at the discharge side and transferred to the hexagonal head 44 on the rocker lever 24. Further, the pre-stressing force of the adjusting device 10 must be selected in such a way that a micro-movement inside the threads 42, 62 caused by overturning or bending moments, introduced by the valve shaft 22, can be prevented. The wear on the thread flanks of the threads 42, 62, created during adjustment or motor operation and causing a loss of pre-stressing force, must be compensated by the lowest possible rigidity of the adjusting device 10.

Furthermore, the particularly extensive maintenance of the preset valve clearance can be achieved by connecting the clamping element, i.e., the pre-stressed bolt 68, with the actuation element in a firmly bonded manner. In this, a weld point or a soldered connection is provided for at a firmly bonded area 92, corresponding to an externally accessible point of contact between the head 70 of the pre-stressed screw 68 and the actuation element 40, for example. Alternatively, the firmly bonded connection can be produced in the firmly bonded area 92, for example by gluing the pre-stressed screw 68 with the actuation element 40.

The invention claimed is:

1. An adjusting device for a valve clearance of a charge-cycle valve in an internal combustion machine, comprising:

a pivoted rocker lever, at one end of which an actuation element is positioned and configured to transfer a force to the charge-cycle valve, and a transmission element is attached to the actuation element at an opposite end to the charge-cycle valve of which a sleeve area is positioned, the sleeve area which is used to support the transmission element with respect to the actuation element, wherein the transmission element has an internal area and an external area, and the internal area has a female thread and the external area has a male thread for supporting the transmission element with respect to the actuation element, and wherein the transmission element uses the female thread with a pre-stressed bolt to support itself at the actuation element, and the transmission element uses the male thread to support itself at a thread of the actuation element.

2. The adjusting device according to claim 1, wherein the female thread and the male thread of the transmission element each have an identical pitch.

3. A method for adjusting a valve clearance of a charge-cycle valve of an internal combustion machine using an adjusting device comprising a pivoted rocker lever, at one end of which an actuation element is attached and configured to transfer an actuation force to the charge-cycle valve, the method comprising the steps of:

attaching a transmission element to the actuation element, wherein the transmission element has an internal area and an external area, attaching a first end portion of a clamping element to the internal area of the transmission element, and bracing the transmission element with the actuation element by applying a torque to the clamping element until a second end portion of the clamping element contacts the actuation element.

* * * * *